US012618308B2

(12) United States Patent
Lee et al.

(10) Patent No.: US 12,618,308 B2
(45) Date of Patent: May 5, 2026

(54) METHOD AND DEVICE FOR HORIZONTAL BORE MINING

(71) Applicant: ILUKA RESOURCES LIMITED, Perth (AU)

(72) Inventors: Christopher Brian Lee, Perth (AU); Pieter Stephanus Esterhuysen, Perth (AU); Tertius Theunis Brits, Perth (AU)

(73) Assignee: ILUKA RESOURCES LIMITED, Perth (AU)

( * ) Notice: Subject to any disclaimer, the term of this patent is extended or adjusted under 35 U.S.C. 154(b) by 78 days.

(21) Appl. No.: 18/685,674

(22) PCT Filed: Aug. 24, 2022

(86) PCT No.: PCT/AU2022/050986
§ 371 (c)(1),
(2) Date: Feb. 22, 2024

(87) PCT Pub. No.: WO2023/023759
PCT Pub. Date: Mar. 2, 2023

(65) Prior Publication Data

US 2024/0368969 A1 Nov. 7, 2024

(30) Foreign Application Priority Data

Aug. 24, 2021 (AU) ..... 2021902690
Aug. 25, 2021 (AU) ..... 2021221701

(51) Int. Cl.
*E21B 41/00* (2006.01)
*E21B 7/04* (2006.01)
*E21B 7/18* (2006.01)

(52) U.S. Cl.
CPC ..... *E21B 41/0078* (2013.01); *E21B 7/046* (2013.01); *E21B 7/18* (2013.01)

(58) Field of Classification Search
CPC ..... E21B 7/046; E21B 7/18; E21B 10/602; E21B 17/18; E21B 21/12; E21B 41/0078;
(Continued)

(56) References Cited

U.S. PATENT DOCUMENTS 3,153,290 A 10/1964 Saito
4,302,052 A 11/1981 Fischer
(Continued)

FOREIGN PATENT DOCUMENTS

WO 1995/33119 A1 12/1995
WO WO-2010000736 A1 * 1/2010 ..... E21B 43/49

OTHER PUBLICATIONS

International Search Report and Written Opinion mailed Mar. 28, 2023, by the ISA/AU, issued in corresponding International Patent Application No. PCT/AU2022/050986, filed Aug. 24, 2022, 16 pages.

(Continued)

*Primary Examiner* — Nicole Coy
*Assistant Examiner* — Nicholas D Wlodarski
(74) *Attorney, Agent, or Firm* — Christensen O'Connor Johnson Kindness PLLC

(57) ABSTRACT

The invention provides a mining tool (30) for mining an underground substantially horizontal seam of material comprising an eductor module (60) and a fluidising module (62). The fluidising module (62) includes a plenum (66) adapted to receive high pressure fluid from a mining string, and one or more fluid jet nozzles (42,43,44) for emitting the high pressure fluid to mobilise material of the seam. The eductor module (60) includes an eductor assembly (69) adapted to recover the mined material to return it as a slurry along the string. In use, the tool is connected to a mining pipe or string (35) extending from the surface to supplying said high pressure fluid to the eductor arrangement and fluidising (Continued)

SECTION A-A nozzles. The eductor assembly is positioned toward the proximal side of the tool which is connected to mining pipe (35). The fluidising jet nozzles are positioned more towards the distal end of the tool, such that when in use, eductor recovers the slurry at said proximal position relative to the string. While the mining tool is continuously withdrawn towards the ground surface along the substantially horizontal borehole, high pressure fluid is fed to the tool to fluidise the material in the seam via the fluidising jet nozzles (42,43,44), and recover the material as a slurry via the eductor arrangement positioned "upstream" from the jet nozzles.

18 Claims, 8 Drawing Sheets

(58) Field of Classification Search
CPC ..... E21B 43/29; E21B 47/0224; E21C 25/60; E21C 41/16
See application file for complete search history.

(56) References Cited

U.S. PATENT DOCUMENTS

| | | | | |
|---|---|---|---|---|
| 4,728,152 | A * | 3/1988 | Pike | E21B 7/20 166/175 |
| 6,152,356 | A * | 11/2000 | Minden | E21B 41/0078 299/8 |
| 6,460,936 | B1 * | 10/2002 | Abramov | E21B 43/29 299/5 |
| 10,428,634 | B2 | 10/2019 | Kinley et al. | |
| 2003/0029617 | A1 * | 2/2003 | Brown | E21B 43/28 299/5 |
| 2013/0106166 | A1 * | 5/2013 | Gilmore | E21B 43/305 299/17 |
| 2016/0008408 | A1 | 1/2016 | Imagawa et al. | |

OTHER PUBLICATIONS

Communication and Supplementary European Search Report mailed May 21, 2025, issued in corresponding European Patent Application No. 22859646.6, filed Aug. 24, 2022, 11 pages.

* cited by examiner

SECTION A-A

SECTION B-B

SECTION A-A

METHOD AND DEVICE FOR HORIZONTAL BORE MINING

FIELD OF THE INVENTION

This invention relates generally to underground mining and particularly but not only with accessing and/or mining an underground seam of a material with minimal removal of the overburden, by way of one or more inclined or horizontal boreholes. In a broad aspect, the invention provides various mining tools and methods for mining an underground seam of material.

BACKGROUND OF THE INVENTION

Where an underground seam of valuable material is located close to or within a reasonable distance of the ground surface, e.g. up to 600 m below the surface, the usual method of recovery is via open pit mining, also commonly known as open cast or open cut mining. There are however many instances where valuable resources are not being recovered because the overall economics of open pit mining including extraction and replacement of the overburden and subsequent site restoration do not allow sufficient return at market prices. In other instances, the valuable seam may be narrow and extend over many kilometres or may be submerged or partly submerged below a local water table and be impractical to dewater.

One proposed solution to these difficulties has been hydraulic borehole mining, which essentially involves drilling and casing a vertical borehole to the seam. The ore is then hydraulically mined by directing high velocity water jets into the seam to form a slurry, and pumping the slurry to the surface via the borehole. U.S. Pat. No. 4,728,152 discloses the use of this method for the recovery of bitumen from tar sands.

In a variation for extracting hydrocarbon fluid from a layer of oil sand, the usual vertical borehole is drilled and cased, and a second borehole is drilled in a curved path from a second well head to access the seam in a horizontal direction. Jet nozzles supplied by respective conduits in the two boreholes disaggregate a zone of the seam to form a cavity from which the material is extracted as a slurry via the horizontal borehole. An example of this arrangement is disclosed in International patent publication WO 2010/000736.

International patent publication WO 2013/062871 discloses a borehole mining system in which the seam is accessed via a drilled and cased borehole that is initially directed at an inclination from the surface and curves into a horizontal direction. A coaxial mining pipe run down the borehole defines an annular passage for delivering high pressure water to operate sets of jet nozzles at the end of the pipe for disaggregating the seam material, which is recovered into the central passage via an eductor pump between the sets of nozzles. The casing or the end of the pipe can be rotated to traverse the water jets, and the nozzles and eductor are repositioned from time to time by retraction of the pipe along the borehole.

International patent publication WO 2015/057657 discloses a borehole mining method that entails delivering four separate fluid streams down a mining string run into the borehole, which may be at any angle from vertical to horizontal. These fluids comprise a high pressure fluid to form jets for disaggregating the material being mined and creating a slurry of the material, air for a shroud to encapsulate and accelerate the high pressure fluid jets, low pressure water to mix with and transport the slurry back to the surface, and gas for an airlift sub to create suction for lifting the slurry to the surface. Again, the pipe is rotated to rotate the jets, and the cavity in the seam grows larger and longer as the mining tool is slowly retracted across the seam and into the casing string.

It is an object of at least preferred embodiments of the invention to provide alternative or improved arrangements for accessing and/or mining an underground seam of material utilising borehole techniques.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

In the first aspect of the present invention, there is provided a mining tool for mining an underground seam of material by being coupled to a pipe structure that extends along a borehole from a ground surface to the seam, which pipe structure having at least a first and second passage for separately delivering high pressure fluid to the mining tool, and a third passage for recovering a slurry containing mined material, wherein the mining tool comprises:

- a plenum being connected to and adapted to receive high pressure fluid from the first passage of the pipe structure,
- one or more fluidising jet nozzles fluidly connected to said plenum and operable with said high pressure fluid to mobilise material of the seam adjacent to the tool, and
- an eductor arrangement adapted to recover and entrain said mined material in said high pressure fluid flow delivered by the second passage, to return said material as a slurry along said third passage,
- wherein said one or more fluidising jet nozzles are distally disposed relative to said pipe structure, and said eductor arrangement is disposed proximally relative to said pipe structure,
- such that when in use, said one or more fluidising jet nozzles mobilise said material and said eductor arrangement recovers said slurry at said proximal position relative to the pipe structure, while said mining tool is continuously withdrawn towards the ground surface along said borehole.

In an embodiment, the one or more fluidising jet nozzles are disposed at least between 0 and 3 m from the eductor arrangement.

In one embodiment, the one or more fluidising jet nozzles are disposed between 1 and 2 m from the eductor arrangement.

In a further embodiment, the mining tool is disposed along a horizontal or substantially horizontal borehole.

In an embodiment, one or more openings providing fluid connection between the eductor arrangement and the borehole include grille or strainer structures for controlling slurry pressure therethrough and/or controlling fragment sizes of the material in the slurry.

In one embodiment, the mining tool comprises two openings disposed on opposing faces of the mining tool.

In another embodiment, the two opposingly disposed openings are vertically level when in use.

In a further embodiment, the grille or strainer structures are adapted to maintain a slurry suction pressure of between 400 and 800 kPa.

In an embodiment, the grille or strainer structures are adapted to maintain a slurry suction pressure of 600 kPa.

In a second aspect of the present invention, there is provided a method for mining an underground seam of material comprising coupling a mining tool to a pipe structure that extends along a borehole from a ground surface to the seam, which pipe structure has at least a first and second passage for separately delivering high pressure fluid to said mining tool, and a third passage for recovering a slurry containing mined material, said mining tool having:

a plenum connected to and receiving high pressure fluid from the first passage of the pipe structure;

one or more fluidising jet nozzles fluidly connected to said plenum and directing said high pressure fluid to mobilise material of the seam adjacent to said mining tool; and an eductor arrangement recovering and entraining said mined material in said high pressure fluid flow delivered by the second passage, returning said material as a slurry along said third passage, said one or more fluidising jet nozzles being distally disposed relative to said pipe structure, and said eductor arrangement being proximally disposed relative to said pipe structure, wherein said mining tool is continuously withdrawn towards the ground surface along said borehole while fluid is fed to said one or more fluidising jet nozzles and said eductor arrangement such that said material is mobilised from said seam and recovered as said slurry through said proximally located eductor arrangement.

In one embodiment, the material adjacent to the tool is mobilised by high pressure fluid directed by said one or more fluidising jet nozzles disposed at least between 0 and 3 m from the eductor arrangement.

In another embodiment, the one or more fluidising jet nozzles are disposed between 1 and 2 m from the eductor arrangement.

In an embodiment, the underground seam of material is mined by the mining tool disposed along a horizontal or substantially horizontal borehole.

In one embodiment, the slurry pressure and/or fragment sizes of the material recovered in the eductor arrangement is controlled by grille or strainer structures comprising one or more openings providing fluid connection between the eductor arrangement and the borehole.

In another embodiment, the slurry is recovered through two of the openings disposed on opposing faces of the mining tool.

In a further embodiment, the mining tool is oriented such that the two opposingly disposed openings are vertically level.

In an embodiment, the grille or strainer structures maintain the slurry suction pressure to between 400 and 800 kPa.

In one embodiment, the grille or strainer structures maintain the slurry suction pressure at 600 kPa.

In vertical borehole mining, jets are provided to scour the walls of the borehole and the mined material falls under gravity to a position below the jets from where it is extracted and returned to the surface. In horizontal or near-horizontal boreholes the mining device with jet nozzles is generally positioned at or close to the bottom (between 0 to 1 m from the floor) of the ore body with the jet nozzles pointing generally upward to release the valuable minerals. However, unlike vertical borehole mining, a horizontal borehole does not have the benefit of gravity to direct and concentrate the released material toward the extraction system for return to the surface.

The extraction system for returning the mined material in a slurry form is typically positioned at the free or distal end of the device. This is intended such that an operator can recover the mined material adjacent the free end of the device. In some instances, this arrangement is combined with movement of the mining device so that the extraction system can be transported over the borehole to retrieve the mined material. This however has a number of difficulties. In particular, the distal or free end of the device is most vulnerable to damage during insertion and movement of the device, and the opening for the extraction system through which the slurry enters can become blocked or damaged by contact with surrounding rock or minerals.

Further, in typical horizontal or near-horizontal bore mining, individual hydraulic lines are provided to each nozzle of the plurality of substantially identical nozzles on the device. In some cases, additional directional jet nozzles are provided to direct the mined material (freed by the mining jet nozzles) toward the extraction system inlet. These directional jets require additional pressure and fluid connections etc. Further these additional directional jet nozzles are pointed away from the ore body in the direction of the extraction device. This is a potentially wasteful use of energy in the mining system solely to force the mining material to the extraction device.

The present invention on the other hand proposes that, counterintuitively, the mobilising jet nozzles are placed at or adjacent the free or distal end (relative to the surface) and the extraction device or eductor arrangement, is placed more towards the proximal end of the device.

The inventive arrangement provides a number of significant advantages over conventional systems. Firstly, arranging the extraction system/eductor inlets more towards the proximal end of the device reduces the possibility of damage to the extraction system, the eductor arrangement and its inlets during insertion. But quite surprisingly this has come without any apparent reduction in operational efficiency. Even though the extraction system is now effectively "upstream" of the jet nozzles, recovery of the mined material via the extraction system operates in a manner at least as well as conventional systems.

Still further the applicants have found that placing the eductor inlet/extraction device more toward the proximal end of the device with the mining jet nozzles placed more towards the distal or free end, provided a number of other unsuspected advantages including more efficient and reliable operation, as well as reduction in blockages and damage.

Although it is not entirely clear why this occurs, the inventors have found that the mined material is reliably recovered as a slurry despite the eductor inlets being placed essentially "upstream" of the mining face formed by the jet nozzles. It is hypothesised that the borehole itself acts to constrain the material allowing it to be reliably drawn into the eductor arrangement via the inlets spaced toward the proximal end from the jets.

And despite the movement or withdrawal of the device toward the surface, which therefore essentially moves the extraction/eductor inlets away from the vacant portion of the borehole, the inventive device and method operates to efficiently and reliably recover the mined material at least as well as conventional systems which position the extractor at or near the free end.

Initially it was believed the inventive arrangement could potentially cause difficulties since it was believed placing the extraction or eductor inlet at the distal end would prove more efficient as it is the last point of contact as the mining device is withdrawn to the surface. It appears however that the continuous fluidisation and flow thereof within the borehole caused by the jet nozzles and the mined minerals is sufficient to efficiently entrain it. This could also be as a result of the quick collapse of the vacant portion of the borehole.

In a third aspect of the present invention, there is provided a mining tool for mining an underground seam of material, comprising a plurality of fluidising jet nozzles arranged to one or more of the following configurations:

wherein a central fluidising jet nozzle (A) and one or more side fluidising jet nozzles (B) are disposed about said mining tool such that they each direct a mobilising stream of fluid at an angle of 1 to 100 degrees relative to each other;

wherein one or more side fluidising jet nozzles (B) are disposed at a longitudinally distal or proximal position along said mining tool relative to said central fluidising jet nozzle (A);

wherein said plurality of fluidising jet nozzles are each configurable to direct said mobilising streams of fluid towards said material adjacent to the longitudinal fore and aft of said mining tool; and wherein said central fluidising jet nozzle (A) and one or more side fluidising jet nozzles (B) comprise differing nozzle outlet diameters, such that in use said plurality of fluidizing jet nozzles mobilise and disaggregate an underground seam of material adjacent to said mining tool.

In one embodiment, the two side fluidising jet nozzles (B) are disposed about the mining tool such that they each direct a mobilising stream of fluid at an angle of 70 degrees relative to that directed by the central fluidising nozzle (A).

In another embodiment, the two side fluidising jet nozzles (B) are disposed about the central fluidising jet nozzle (A) such that they collectively form a longitudinally spaced diagonal array of nozzles adapted to direct a mobilising stream of fluid in a 180 degree angle around the mining tool.

In a further embodiment, the central fluidising jet nozzle (A) comprises a smaller nozzle outlet diameter relative to the one or more side fluidising jet nozzles (B).

Vertical or horizontal bore mining is an extremely harsh environment wherein failure of the device is not uncommon. Typically, a device for vertical or horizontal bore mining includes a plurality of substantially identical nozzles fed with a mining fluid to disaggregate or mobilise the valuable mineral from the ore body. These jet nozzles are typically fed with individual direct lines in an effort to maintain reliable pressure to each nozzle. Further, such systems generally provide substantially identical nozzles and fluid feed lines.

However, such a multitude of fluid feed lines brings with them a number of failure points as well as increased initial expenditure and maintenance costs. Such systems are further very inflexible and are difficult to tailor to suit a particular ore body. In effect, the systems are a "one size fits all" device with the only variable being essentially the fluid pressure applied to the nozzles.

The applicants have determined that conventional feed systems and nozzle configurations are both inflexible and prone to failure.

The differential nozzle system of the present invention allows an operator to provide different fluid pressures, volumes etc to the ore body in different directions. Further, the use of a plenum to feed the nozzles substantially reduces the cost and potential failure points of the direct feed systems of the prior art, as well as providing a more even pressure distribution of the fluid delivered. In addition to improving performance and reducing unnecessary wear, these features in turn allow for modifications or "tailoring" of the mining tool to suit the particular needs of the ore body at hand.

For instance, ore bodies of significantly different sizes and shape can be accessed and recovered using the inventive device. As an example, a narrow, tall ore body or a shallow, flat ore body can both be retrieved using the present invention due to its differential nozzle configuration. This would not be possible with conventional systems without substantial and costly continual variation of the hardware and control systems of the conventional hydraulic mining setup.

In a fourth aspect, the present invention provides a mining tool for mining an underground seam of material by being coupled to a pipe structure that extends along a borehole from a ground surface to the seam, wherein the mining tool comprises:

an external housing, a plenum within the housing connected to and adapted to receive mining fluid from a first passage of the pipe structure, one or more fluid jet nozzles fluidly connected to said plenum and operable with said mining fluid to mobilise material of the seam adjacent to the tool, and an eductor arrangement positioned within said housing, spaced and fluidly isolated from said one or more fluid jet nozzles, said eductor arrangement being adapted to receive a motive fluid from a second passage of the pipe structure, and recover the mined material and return it as a slurry along a third passage of the pipe structure;

said housing defining respective first, second and third substantially longitudinally extending fluid channels fluidly connecting respective passages of said pipe structure to said one or more fluid jet nozzles and said eductor arrangement, whereby said housing provides a first channel for supplying mining fluid to said one or more fluid jet nozzles, a second channel for supplying motive fluid to said eductor arrangement, and a third channel to return the mined materials as a slurry to the pipe structure, wherein said housing is arranged to fluidly isolate the mining and motives fluids prior to delivery to the plenum and eductor arrangement respectively.

In a preferred embodiment, at least said first and second passages are provided by annular channels extending along at least part of the length of the housing. More preferably said annular channels are formed as a nested array with the first and second annular channels being substantially co-axial and of differing radius nested within each other and the third essentially tubular channel being provided co-axially and radially inward of the first and second channels. The eductor arrangement is also preferably positioned within and substantially co-axially with said third channel.

In another embodiment said housing is provided by two portions, a nozzle portion defining said plenum and housing said one or more jet nozzles, and an eductor portion housing said eductor arrangement and defining eductor inlets to retrieve and feed said slurry to said eductor arrangement, said first, second and third passages being formed in said eductor portion, and at least said first passage being formed in said nozzle portion, said eductor and nozzle portions being connectable to align respective first passages in the eductor arrangement and nozzle housing portions.

The first and second annular channels can be continuous or formed as an annular array of tubular ports.

The ability of the current device to supply fluids separately to both the jet nozzles and eductor arrangement by way of the nested annular channels, without the need for additional separate fluid lines, is a significant advantage over conventional systems. The use of a 3 core housing to match the 3 core (3C) pipe system allows for a reliable fluid feed system as well as efficient return of the mined slurry without the added expense. Complexity and potential failure points of the prior art are largely eliminated.

The elegant design of the present invention allows different fluid pressures to be applied to the jet nozzles and eductor arrangement since they remain fluidly isolated. Further in the preferred embodiment where the eductor arrangement is positioned towards that end of the device proximal to the 3C pipe connection, and the nozzles are positioned more towards the free or distal end of the device, the design of the invention has the first channel as the radially outermost channel array extending from the 3C pipe connection, outside and bypassing the eductor arrangement to the plenum to feed fluid to the fluidising nozzles.

The next innermost channel is the second channel, feeding fluid to the eductor arrangement. This second channel essentially terminates adjacent to the eductor arrangement to feed fluid to the eductor arrangement. The third channel is the innermost channel and extends from the 3C pipe to the eductor arrangement (or vice versa in fluid flow direction) wherein it retrieves the mined material, released from the ore body, as a slurry for return to the surface. The use of the housing as a fluid feed and return system without the need for additional and separate fluid piping etc provides a reliable and efficient system integrating multiple functions in one elegant device. Connection to the 3C piping system, as well as replacement and repair of various components is quite straightforward compared with conventional systems.

In a fifth aspect, the present invention provides, a device for mining an underground seam of material and adapted to be coupled to a pipe structure that extends along a borehole from a ground surface to the seam, wherein the device comprises:

- two interconnectable modules, including:
  - an eductor module releasably connected at its proximal end to said pipe structure and housing a diffuser assembly adapted to receive a motive fluid from said pipe structure,
  - a fluidising module releasably connected to the distal end of said eductor module and defining a plenum housing a plurality of fluidising nozzles adapted to receive a fluidising fluid fed from said pipe structure and through said eductor module, and
  - one or more eductor inlets on the eductor module to receive and transport a slurry of minerals and fluid to the ground surface along the pipe structure,
- wherein said diffuser assembly and said fluidizing nozzles are releasably mounted within their respective modules, and
- wherein said modules have substantially the same external diameter and are adapted to be connected co-axially in use.

In a preferable embodiment, at least two said inlets are disposed on opposing faces of said eductor module.

The fifth aspect of the present invention is particularly useful in terms of the adaptability of the device to differing conditions, as well as the ease of maintenance, while at the same time still having the eductor positioned proximally and the fluidising nozzles positioned distally relative to the surface. As will be explained more fully below, having separate releasably connectable modules for the fluidising nozzles and eductor arrangement allows for much easier repair and replacement of the various components. If the nozzles or eductor require modification, repair or replacement, the modules can be disengaged and relevant action taken. The access to the nozzles in the fluidising module for instance simply requires disengagement with the eductor module. The nozzles can then be modified, moved, repaired or replaced in a rapidly efficient manner. It is not necessary to decouple multiple fluid lines to each nozzle etc.

This has not been possible with such distally placed fluidising nozzles prior to the present invention. Without the aforementioned inventive modular arrangement, significant downtime would be incurred in maintenance and modification of the device.

Similarly, if adjustments or modification of the eductor arrangement is required, once the modules are disengaged, the educator assembly in a preferred embodiment can be simply extracted from its housing and suitable action taken. The inventive eductor module not only performs its function to capture and return the valuable mined material to the surface as a slurry, but it also provides the necessary fluidising material e.g., water, to the distally placed fluidising nozzles. Such a modular arrangement has significant advantages over conventional systems.

The present invention includes one or more of the above-mentioned aspects taken individually or in any and all combinations thereof.

BRIEF DESCRIPTION OF THE DRAWINGS

The invention will now be described, by way of example with reference to the accompanying drawings, in which.

DETAILED DESCRIPTION OF THE EMBODIMENTS

It will be understood that the invention disclosed and defined in this specification extends to all alternative combinations of two or more of the individual features mentioned or evident from the text or drawings. All of these different combinations constitute various alternative aspects of the invention.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

When discussing the features comprising the mining tool, their locations may be referenced using relative locations such as a distal or proximal location, relative to each other or a specific feature. Accordingly, the mining tool comprises a "proximal" end, and "distal" end relative to the mining pipe to which it is connected and which leads to the surface. As such, the proximal end is defined as that end of the mining tool relatively close to said mining pipe and thus the surface, while the distal end is that end of the mining tool comparatively further away from the mining tool and thus inserted further into the borehole when in operation. The "fore" and the "aft" are used in similar contexts, and are defined to mean the same general directions as "distal" and "proximal", respectively.

Similarly, the mining tool and its constituting features can also be defined according to the flow direction of fluids it directs. In this regard, the "upstream" or "downstream" location and/or direction is defined relative to the fluidising and motive fluid flows (as will be discussed below) that are both directed from the surface level to the mining tool for respectively mobilising the targeted seam of material or as a motive-fluid for the eductor. As such, "upstream" is defined to mean a position or direction towards or closer to the surface level facilities via the mining pipe. Conversely, "downstream" is used in the context of a position or direction towards or closer to the most remote location of the borehole, viewed from the surface-level origin of the borehole.

Figure 1:
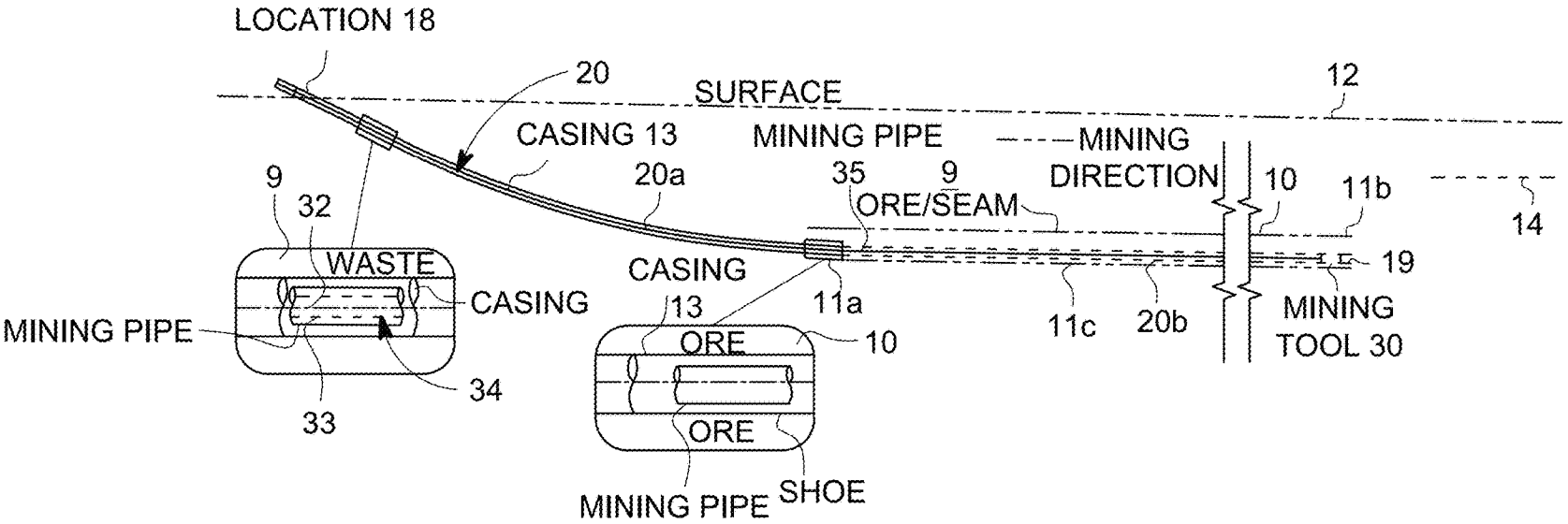
FIG. 1 is a not-to-scale cross sectional view, including local enlargements of a mine configuration accessing an underground seam of a valuable material, with the mining tool in position at the far side of the seam ready to commence mining.

The respective aspects of the invention will now be described in the context of accessing and mining an underground seam 10 of a mineral sands resource such as rutile, ilmenite and/or zircon, in the geological situation depicted in FIGS. 1 and 2. For the purposes of exemplification, the seam 10 is a longitudinal seam substantially longer than it is wide or deep. For the purposes of exemplification, seam 10 may, for example, be located around 70 m below a ground surface 12, be several kilometres long, and average 300 m in width and 5 m in height. It is submerged in an aquifer that extends up to a water table level 14 about 20 m below ground surface 12.

The underground seam 10 is accessed, in accordance with a preferred embodiment of the invention, in a sequence of operations as follows. In the first step, a ground drilling tool such as a drilling rig is utilised to drill a borehole 20 from a location 18 on ground surface 12 laterally of the seam 10 to a second location 19 at the opposite side of the seam 10. The borehole 20 may, for example, be of a diameter in the range 400 to 450 mm. The directional drilling tool, with its trailing drill string, is guided to commence borehole 20 at a substantial inclination to the horizontal, at least 15°, but then to curve around through the ground material 9 about the seam 10 to enter a proximate side boundary 11*a* of the seam 10, then horizontally through and across the seam 10 to the opposite, distal, side boundary 11*b*. The arrangement is such that a remote section 20*b* of the borehole traverses seam 10 horizontally, or substantially horizontally at a location about 0.5 m on average above the floor 11*c* of the seam, in order to minimise dilution from the floor. Of course, in other contexts where the seam's floor is inclined, the borehole would traverse the seam at a corresponding inclination.

Figure 2:
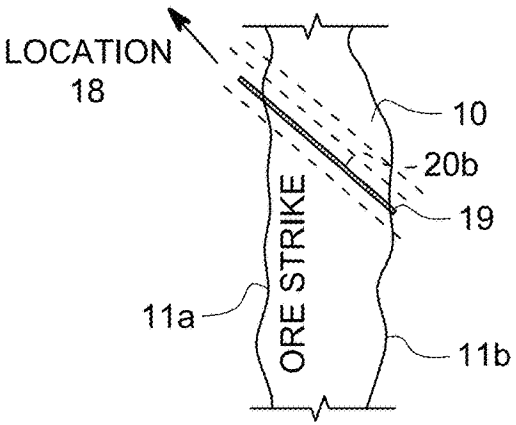
FIG. 2 is a plan view of the site showing the orientation of the borehole to the longitudinal alignment of the seam.

As depicted in FIG. 2, the alignment of borehole 20 is such that remote section 20*b* extends obliquely to the longitudinal alignment of the seam 10, at an angle typically around about 13°. The result is that this section extends up to 600 m in the seam. The total length of the borehole from entrance location 18 to location 19 may be 1 km or more.

The initial section 20*a* of borehole 20 is cased if necessary: in this embodiment, casing has been installed and is depicted at 13. The casing 13 would be typically installed during the drilling process: when the drilling tool first reaches the seam 10, drilling is stopped and casing 13 is washed over the drill string to the proximate seam side boundary 11*a*. Drilling is then recommenced.

Once the borehole has been drilled and if necessary cased, mining tool 30 at the head of a trailing mining pipe 35 is pushed down the borehole by a suitable drilling rig that has been converted to handle the mining pipe 35. Conversion includes mainly the provision of a mining swivel and mining foot clamps to handle the mining pipe 35, which is larger than the conduits typically driven by the drilling rig. The mining tool 30 and mining pipe assembly is pushed down the borehole until the mining tool 30 reaches location 19 at the far side 11*b* of the seam 10.

In the first embodiment of the invention, mining pipe 35 is a known "three core" (3C) mining pipe of co-axial construction having a central passage 32 and two surrounding annular passages 33 and 34. The mining pipe is provided in segments of e.g. 6 to 12 metres in length that are continuously added as the pipe is driven down the borehole. Segment couplings are threaded, i.e. screwed pipe couplings designed to minimise energy losses and to facilitate gentle curvature of the pipe as it traverses the curving borehole.

The facilities on the surface are generally configured for delivering high pressure fluid, typically water, to respective intermediate and outer annular pipe passages 33 and 34, and for recovering a slurry of mined material from central passage 32. The mining tool 30 is initially positioned with its distal or free end close to, but displaced from, distal seam side boundary 11*b*, ready to commence mining. Central passage 32 is sized to maintain the desired minimum slurry transport velocity in order to minimise particulate settlement in the line.

The mining tool 30, configured as the first embodiment of the invention, will now be described with reference to FIGS. 3 to 10.

Figure 3:
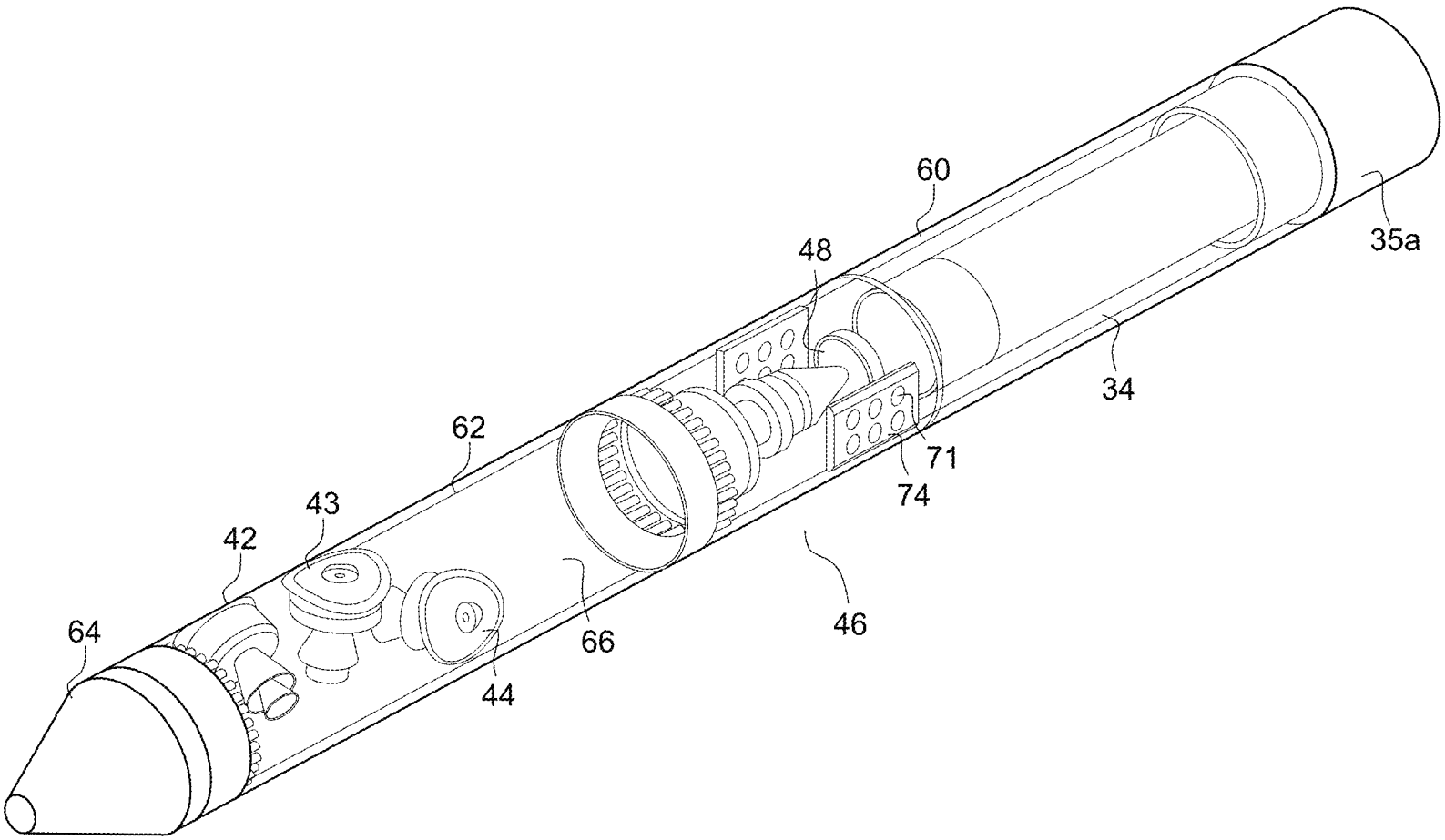
FIG. 3 is an isometric view of the mining tool of FIG. 1, rendered semi-transparent for purposes of illustration.

As shown in FIG. 3, the mining tool is of modular form, comprising at least a pair of coupled modules 60, 62. Eductor module 60 is adapted to be coupled to the end of mining pipe 35 at one end, via a low profile adaptor module 35*a*, and at its opposite end to the rear end of fluidising or mining module 62. The one or more fluidising nozzles 42,43,44 located on the fluidising jet module 62 are disposed toward the distal or downstream end of said mining tool relative to the eductor arrangement comprising the eductor module 60, which is located toward the proximal or upstream end of the tool 30.

Figure 8:
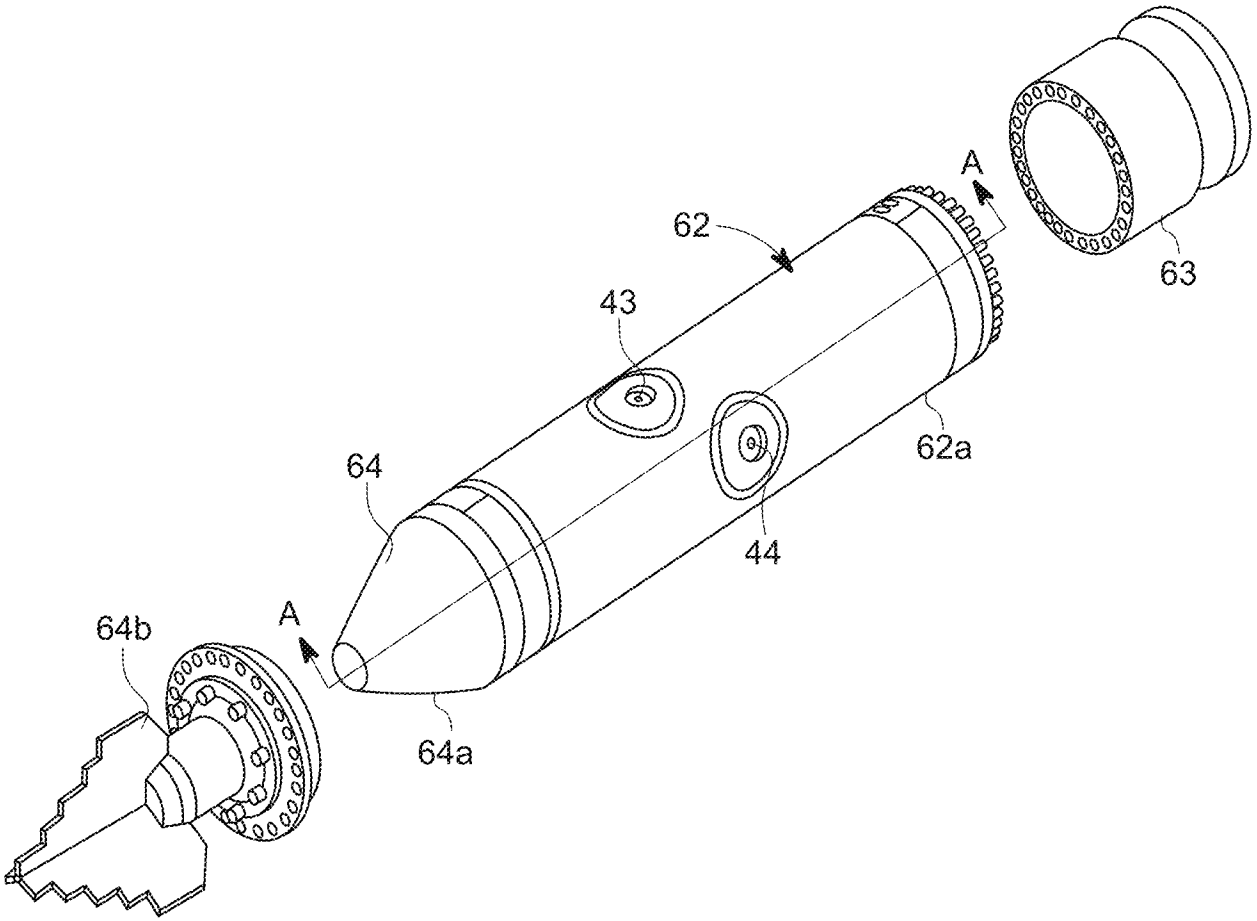
FIG. 8 is a non-transparent isometric view of the fluidising jet module comprising the mining tool illustrated in FIG. 3.

As shown more clearly in FIG. 8, in an alternative embodiment, modules 60 and 62 can be axially and fluidically connected via an extension housing 63 placed therebetween. Such an extension housing (of any length), allows the distance between said nozzles and the eductor assembly 69 (FIG. 6, discussed below) to be adjusted by extending the length of first plenum 66 (discussed below).

The front facing end of fluidising module 62 may be closed by or mounted to a nose cone 64. Again, with reference to FIG. 8, drag bit combs 64*b* may be provided on the leading pointed surface 64*a* of the nose cone 64. The drag bit combs 64*b* comprise a plurality of leading edges protruding from the pointed front face adapted to efficiently divide and pass fluids towards the sides of said mining tool. In embodiments where the drag bit combs 64*b* are provided, fluid resistance is reduced when inserting said mining tool into the borehole.

All three modules include a generally tubular wear resistant outer housing 60*a*, 62*a*, 64*a* of substantially same diameter such that they provide a smooth cylindrical profile when coaxially assembled. The modules can be coupled using a taper lock/clamp ring design, a tapped screwable design and/or a flanged bolt-on design. Each coupling is made water-tight using O-rings inserted between each module.

Figure 9:
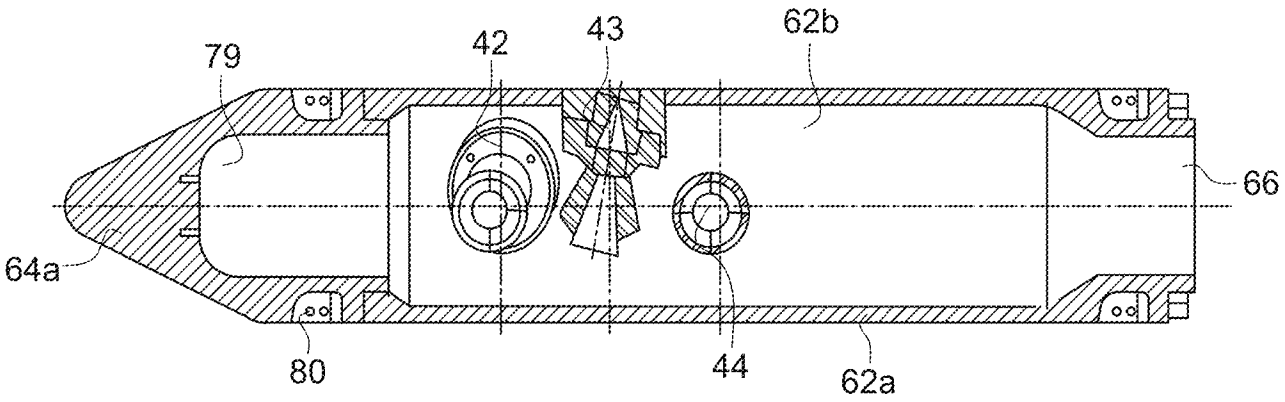
FIG. 9 is an axial section plan view of the fluidising jet module taken along section A-A of FIG. 8.
Figure 10:
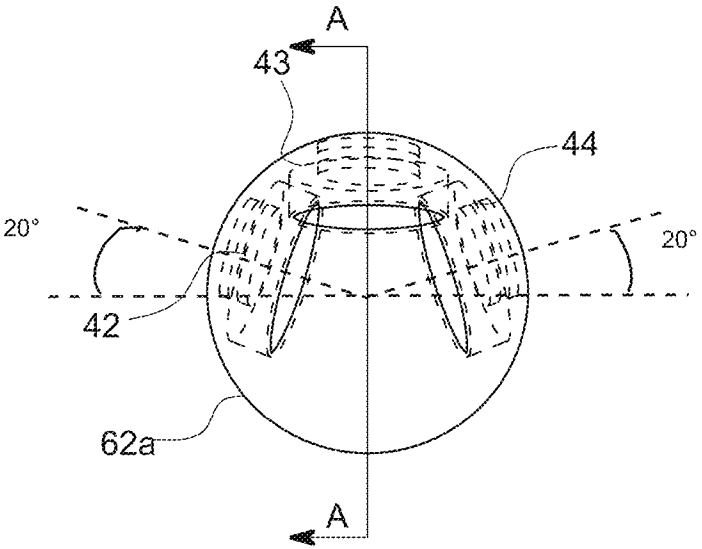
FIG. 10 is a simplified transparent cross-sectional plan view of the nozzle arrangement comprising the fluidising jet module.

As shown in FIGS. 8,9 and 10 the fluidising module 62 is provided with an internal plenum 66 defined by an internal cylindrical surface 62*b* of housing 62*a*. In use, the plenum 66 is fed a high pressure fluid from the mining pipe 35 via the eductor module 60 (described below). This high pressure fluidising fluid e.g. water, passes from the annular passage 34 in the mining pipe, through first outermost channel 34' in the eductor module 60 (see FIG. 6), and via annular array of tubular ports 34" (see FIG. 7) in a crossover block 60*b* into the plenum 66.

With reference to FIGS. 8, 9 and 10, the fluidising jet nozzles 42, 43, 44 are mounted in and fed by fluid in plenum 66. Preferably, the nozzles each comprise a modular nozzle unit mounted to the body of the first plenum 66, such that they can be easily replaced or repaired.

While the jet nozzles can be disposed in any desired configuration or array, the nozzles are preferably disposed in a diagonal array at longitudinally spaced locations. In one embodiment, a central nozzle 43 is directed substantially vertically with other nozzles 42,44 placed fore and aft respectively of centrally disposed nozzle 43. The fore and aft nozzles 42,44 are adapted to face substantially laterally of the tool.

It will also be noted that in the embodiment shown all nozzles are essentially at or above the axis of the fluidising module 62 (e.g. see FIG. 10). Accordingly, the nozzle array can be disposed on one semi-circular face of the mining tool so as to collectively direct high pressure fluid jets in an approximately 180° sweep above the tool. This sweep of the jets may, if desired, be angularly slightly larger than 180°, so as to have a small portion directed outwardly and downwardly relative to said tool's horizontal plane. As such, said nozzles can be disposed on the surface of the mining tool to direct the high pressure fluid jets at a plurality of angles relative to each other, each ranging from 0 to 100 degrees. Alternatively, the nozzles can also be arranged as to direct high pressure fluid jets in a fan smaller than 180 degrees, such that the jets are angled slightly upwards from the horizontal plane of the mining tool i.e. the nozzles are angled from 0 to 100 degrees relative to each other.

FIG. 9 illustrates the side nozzles 42 and 44 longitudinally spaced relative to the central and upwards facing nozzle 43, and are located on substantially opposing sides of the substantially tubular mining tool. As shown in FIG. 10, the opposing nozzles 42 and 44 are preferably both disposed on the mining tool at around 70 degrees from the central nozzle 43 such that the nozzle array collectively directs high pressure fluid jets 41 in a sweep of approximately 140 degrees above the mining tool.

The nozzles 42,43,44 are also typically adjustable to direct the fluid jets somewhat fore or aft with respect to the tool axis. This can be done by physically replacing the nozzle units with differing fluid jet emission angles or by mounting nozzle units in which the jet direction is adjustable via remote control. According to a number of factors such as entrained solids concentration, desired flowrate, material characteristics and stope profile, the nozzle angles can be adjusted to direct a fluidising jet between 0 and 40 degrees towards the fore or aft of the mining tool, relative to the longitudinal axis of the tool. The nozzles 42, 43 and 44 shown in FIG. 9 are preferably angled around 20 degrees towards the aft of the mining tool.

Figure 4:
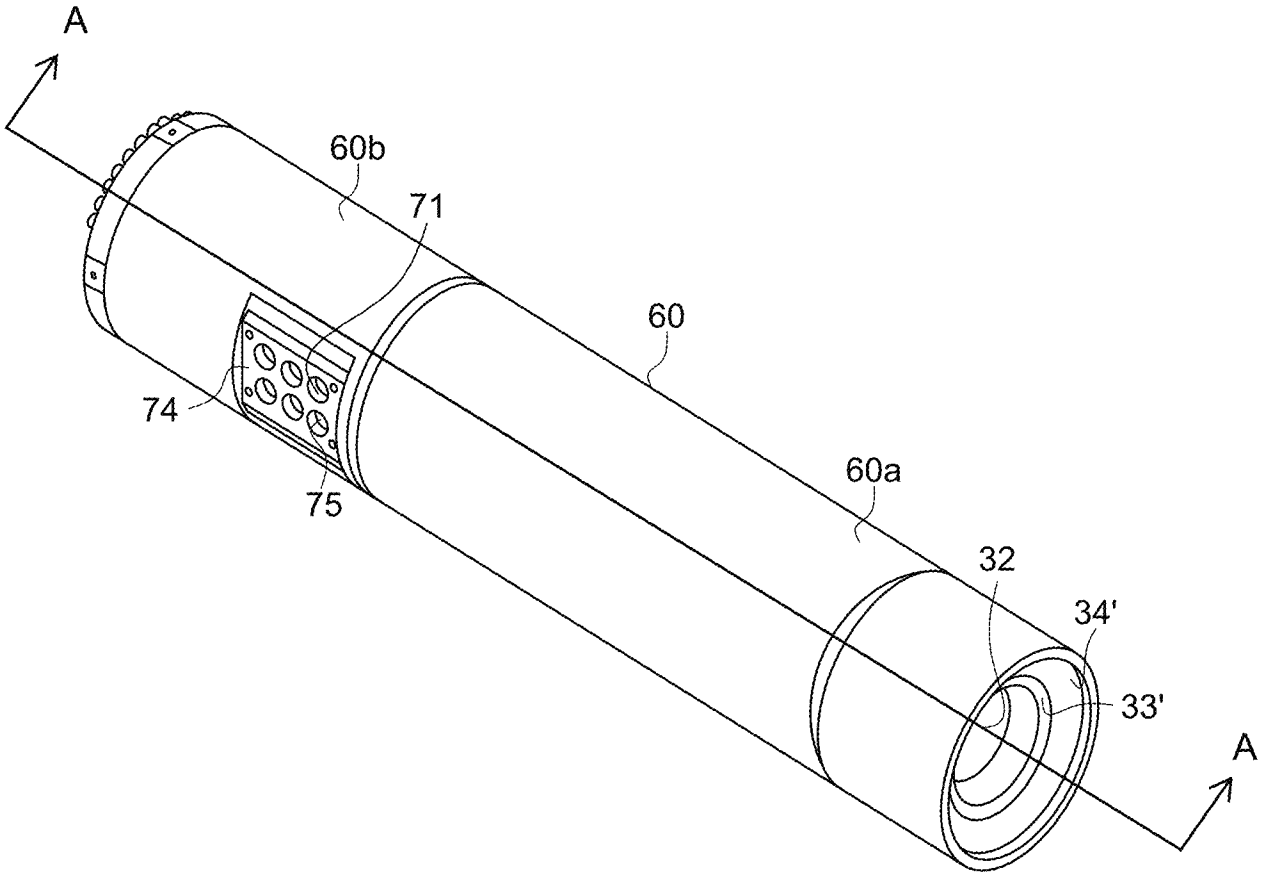
FIG. 4 is a non-transparent isometric view of the eductor module comprising the mining tool illustrated in FIG. 3.
Figure 5:
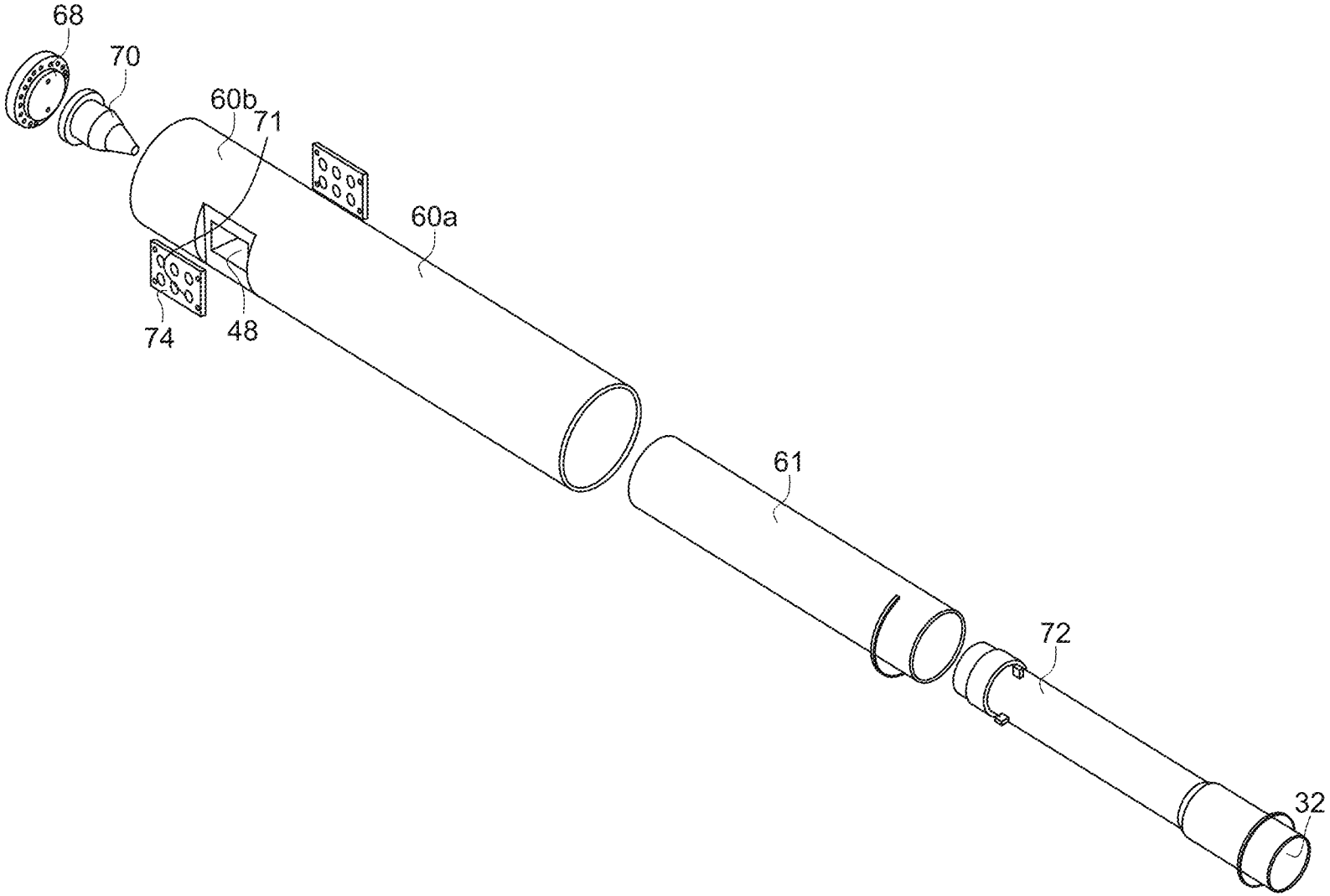
FIG. 5 is an exploded view of the constituent components that form the eductor module of FIG. 4.
Figure 6:
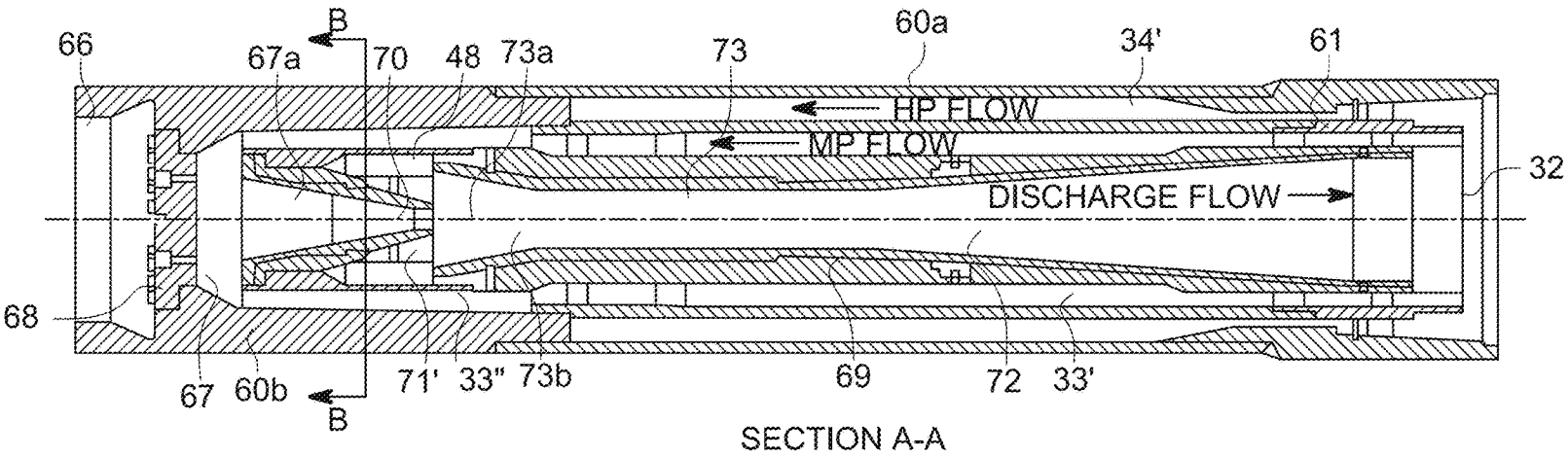
FIG. 6 is an axial section plan view of the eductor module taken along section A-A of FIG. 4.

Referring now to FIGS. 4,5 and 6 the eductor module 60 acts to extract or retrieve the material disaggregated from the seam as will be described below. The eductor module has a housing 60*a*, an intermediate tube 61 and central tubular channel 32. Between said housing 60*a* and tube 61, annular passageway or channel 34' is formed. Similarly, between intermediate tube 61 and central tubular channel 32, annular passageway or channel 33' is formed.

Again, it can be seen that once the eductor module 60 is disengaged from fluidising module 62, access to its contents namely tubes 61 and 32 and hence the eductor assembly 69 is quite straightforward for maintenance, modification, replacement etc.

Within the eductor module 60 is an eductor assembly 69 comprising diffuser assembly 72, a diffuser throat 73 and motive nozzle 70 to form an axially symmetric eductor arrangement, with the diffuser throat entry 73*a* downstream of the motive nozzle 70 (in this case downstream being towards the proximal end of the tool) and the converging portion 73*b* of the diffuser and suction chamber 48 disposed about a rearward conical portion 67*a* of second plenum 67 that ends at nozzle 70.

The motive nozzle 70 is fed pressurised motive fluid such as water via annular channel 33' and ports 33". Such fluid is fed from the mining pipe 35 (not shown) passes along passageway 33' via port 33", into plenum 67 and into motive nozzle 70. This motive fluid for the diffuser assembly 72 creates a low-pressure volume within the suction chamber 48 as would be known to the skilled addressee. Inlet ports 71 are provided on either side of the eductor module 60 from where mined material can enter the eductor assembly 69 as a slurry being a mixture of particulate material entrained in groundwater and fluidisation fluid which emanates from the fluidising jets 42,43 and 44. This slurry is then directed along diffuser assembly 72 and hence into and along passage 32 by the eductor motive jet emitted by motive nozzle 70, disposed just upstream of the minimum restriction point at the diffuser throat entry 73*a* of the diffuser assembly 72.

In conventional borehole mining systems it is generally desired to have the extraction/retrieval means at the distal or free end of the mining tool, and fluid connections to the mining or fluidising jets is quite straightforward. Piping is generally direct fluid lines to each fluidising/mining jet. However, since the present invention proposes to place the jet nozzles 42,43,44 toward the distal end of the device, with the extraction/eductor system toward the proximal end, it is not possible or desirable to have such a "one to one" fluid supply system.

It will be appreciated that the annular passageways 34' and 33' together with cylindrical or tubular ports 33" and 34" of the cross block 60*b* in the eductor module 60 are shaped to pass between and about the internal module structure that defines inlet ports 71 and suction chamber 48. Preferably, the ports 33" and 34" are provided as clusters disposed in an arcuate manner around the horizontally and laterally disposed suction chamber 48.

Figure 7:
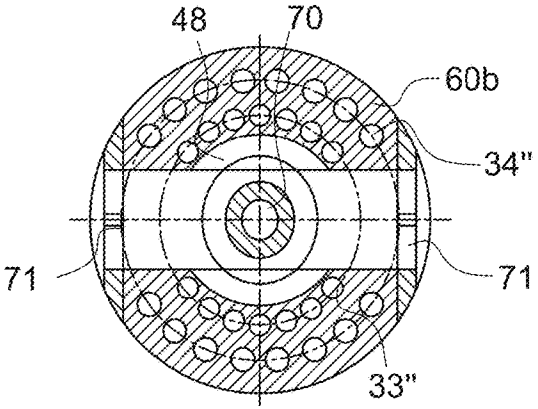
FIG. 7 is a cross-sectional view of the eductor module taken along radial section B-B illustrated in FIG. 6.

As shown in FIG. 7, the tubular ports 34" are preferably arranged in two arcuate clusters around the suction chamber 48 of eductor module 60 to feed the fluid from annular passageway 34' to plenum 66. From the plenum, this fluid is delivered to plurality of fluidising jet nozzles. As discussed below preferably three fluidising jet nozzles 42, 43, 44 are disposed in said plenum 66 and are directed outwardly of housing 62*a* to disaggregate the minerals in the ore body.

In a similar fashion, tubular ports 33" fed fluid from annular passageway 33' to the smaller second plenum 67. As shown in FIG. 6, baffle 68 may be provided at the forward end of the eductor module 60 thereby defining a sealed boundary between a rearward smaller second plenum 67 for the motive nozzle 70 described in due course, and the larger forward plenum 66 for the fluidising jet nozzles 42, 43, 44. The second plenum 67 is adapted to receive a fluid flow from the second or intermediate passageway 33 of the mining pipe via a corresponding annular passageway 33' of the eductor module 60 and tubular ports 33" of the cross block 60*b*.

As shown in FIG. 7, passageway 33' preferably comprises two arcuate clusters of pipes disposed between the suction chamber 48 and tubular ports 34", directing fluid flow therearound said chamber. This fluid flow is distinct and separate from that fed to said first plenum 66 through annular passage 34 such that fluid pressures and flow rates can be adjusted accordingly to suit the requirements for either the fluidising nozzles and/or the eductor.

Operation of the mining tool will now be discussed.

The modules 60, 62 and 64 are coaxially connected to each other and then to the mining pipe. The device is positioned within the borehole and pressurised fluid provided to the fluidising/mining jets and eductor as disclosed above. Both the fluidising and motive fluid flowrates are gradually ramped up to operational flowrates and pressures. Once at an operational flow and pressure, the jet nozzles 42, 43 and 44 start emitting fluidising jets that disaggregate a semi-circular zone or sweep of seam material as the mining tool is drawn back through the seam, towards the ground surface. Preferably, the disaggregation is performed as a fluidisation process rather than a cutting process, achieved by a small number of high volume larger nozzles rather than a larger number of smaller nozzles. In order to achieve a steady fluidisation of the adjacent seam material, each nozzle is adapted to direct a high-pressure fluid jet sufficient to fluidise the target seam material forming a semi-circular "reverse cone" of fluidised material flowing adjacent to the mining tool. While the fluid pressure required to disaggregate said target material will depend on several operational factors such as the mineral type, seam strength and borehole pressure, mineral sands targeted in this invention require jet pressures of 100 to 140 bar (10,000 to 14,000 kPa). Preferably, the nozzles are adapted to direct fluid jets at approximately 120 bar.

The above jet fluid pressure can be further optimised to the mineral material to be mined, the seam shape and/or desired fluid flow by adjusting the outlet diameter of each nozzle. The emission velocity, and thus the impact energy, of the jet fluid can be increased by reducing said diameters, resulting in an increased cutting of the seam material adjacent to the adjusted nozzle. Conversely, if seam fluidisation is preferred, a comparatively larger nozzle diameter is used to provide increased flowrate, particle fluidisation and material flow underground. As such, strategic placement of nozzles with differing diameters can aid in the mobilisation of the target material by providing fluid flow with an appropriate mixture of cutting and/or fluidising characteristics for maximising overall material flow and disaggregation inside the seam. Accordingly, the nozzles disposed on the mining tool can range in outlet diameter from 5 to 40 mm. Preferably, nozzles comprising outlet diameters of 8 to 20 mm are disposed along the mining tool to maximise fluidisation and recovery. In a preferrable configuration, nozzles 42,44 disposed on the side of said mining tool are larger than the central vertically disposed nozzle 43. In one particular embodiment the side nozzles have a diameter of approximately 14 mm and the central nozzle has a diameter of approximately 8 mm.

The disaggregated material resulting from the cutting and/or fluidising fluid jets, fall into a so-called capture zone 46 of relatively low pressure on either side of the eductor module 60 adjacent one or more inlet ports 71 at the periphery of housing 60*a*. The disaggregated material is mixed with and entrained in ground water and/or the high pressure jetted fluid when and as it falls into this low-pressure capture zone.

Additionally or alternatively, the fluidisation fluid jets are directed at the seam to cause substantial fluidisation of the adjacent seam material. The fluidised material flows inside the seam towards the capture zone, from where it is collected and recovered as a slurry via the one or more inlet ports 71.

Furthermore, the loss of seam integrity caused by mobilising and removing said seam material promotes further erosion or partial collapse of the surrounding material, causing further fluidisation of the targeted seam. Either or a combination of the above flow characteristics can be used to promote mobilisation and substantial recovery of the targeted seam material using the inventive device and method.

The resultant slurry containing particulates of material released from the seam is collected from the capture zone 46 through one or more inlet ports 71 in the eductor module 60, from where it passes into a suction chamber 48 that communicates with central passage 32 of mining pipe 35 and adaptor module 35*a* via diffuser 72 containing a diffuser throat 73. There may be an inlet port or ports 71 on opposite sides of the tool, or at different angular positions, and/or one inlet port 71 on the top face of housing 60*a*. In some embodiments, these ports are disposed substantially level with the axis of the device or vertically lower positions about the mining tool compared to the nozzle array in order to effectively receive the slurry created by fluidising the seam material. In a preferred embodiment where the nozzle array is arranged to direct a fluidising fluid in a 140 degree sweep above the tool, two side inlet ports 71 are disposed on opposing lateral sides of housing 60*a*.

This process of fluidising the seam material followed by capture and transport to the surface as a slurry continues as the mining tool is withdrawn from the borehole. The jet nozzles 42,43,44 disaggregate and fluidise the material from the seam, it becomes entrained and mixed with both water from the fluidising jets and groundwater, from where it is recovered/collected by the eductor module 60 and returned to the surface.

It will be noted however that the one or more inlet ports 71 and the eductor assembly 60 are toward the proximal end of the device. This is entirely counterintuitive. Having the recovery means essentially upstream of the fluidising and/or cutting jets would seem inefficient. But the inventors have arrived at an elegant and efficient method and design which not only operates at least as well as prior art systems but, as described above, provides a number of benefits over conventional systems.

There are several factors that are considered and balanced to determine the optimal spacing of the eductor arrangement from the fluidising and/or cutting nozzles in a proximal/upstream direction. Such factors include, but are not limited to, inlet port numbers and arrangement, nozzle fluid pressure, solids entrainment concentration, stope geometry, mining tool size and suction pressure generated by motive fluid flow rate and backpressure. Accordingly, the one or more inlet ports for the suction chamber can be disposed from the one or more nozzles in the proximal or upstream direction at distances ranging from 0 to 5 metres. Preferably, they are spaced 1 to 4 metres from each other. More preferably, the one or more eductor inlet ports are spaced 1 to 2 m from the central vertical nozzle of a diagonally disposed nozzle array and most preferably approximately 1.5 meters.

These one or more inlet ports 71 may also comprise respective grille, screen or strainer structures that are adapted to provide sufficient suction pressure throughout the suction chamber 48 and the diffuser 72 for the eductor mechanism, while also controlling the entrained particle sizes of the mined material admitted into the eductor module for recovery to ground level. Accordingly, these grille or strainer structures are generally specified to allow a certain flow rate of slurry into the eductor module for any given solids concentration, desired recovery flowrate and particle size. As such, the target slurry flowrate for these grille or strainer structures can range from 50 to 500 $m^3$/h, preferably between 100 and 300 $m^3$/h. In a particular operational condition, the grille or strainer structure 74 is sized to allow a slurry flowrate of about 175 $m^3$/h to produce a suction pressure of around 6 bar inside the suction chamber.

Further to the above, the grille or strainer structure is also specified to control the over size of the slurry-entrained seam material passing into the eductor arrangement. Controlling the particle sizes in the form of particle diameter is important in ensuring the particle velocity is maintained throughout the mining pipe between the mining tool and the ground surface. By maintaining sufficient particle velocity, sedimentation and blockages inside the mining pipe can be avoided. Accordingly, the grille or strainer structure is specified to allow slurries comprising particles with diameters between 20 to 99% of substantially the narrowest point of the recovery passage to ground level-namely the diameter of throat entry 73*a* diffuser throat 73 comprising the eductor assembly 69.

In order to achieve the above operational parameters, the grilles or strainer structure is adapted accordingly. A range of grille arrangements can be used, including, but not limited to, bar grilles, perforated grates, rectangular grids and wire-constructed filter mesh. The material used for said grille or strainer structure is adapted to the abrasive operational conditions of the mining tool. Accordingly, material used include, but are not limited to, hard wearing metal alloys such as high-carbon abrasion-resistance (AR) steel, ceramics such as metal-borides, nitrides or carbides and/or structural metals coated with said ceramics.

In order to achieve the desired operation parameters, the number, size and shape of the perforations are carefully optimised. As such, the number of holes can range from 2 to 300, with hole sizes ranging from 100 to 10 mm diagonally. In one preferable embodiment illustrated in FIGS. 4 and 5, the one or more inlet ports 71 comprise a tungsten carbide grid 74 with six circular through holes 75. Preferably, these through holes are 43 mm in diameter.

The particulate material, entrained in groundwater and jetted fluidising fluid, is directed as a slurry along diffuser assembly 72 and hence into and along passage 32 by an eductor motive jet emitted by motive nozzle 70, just upstream of the minimum restriction point of throat entry 73*a* of diffuser throat 73.

It will be appreciated that the longitudinal tubular passages 33" and cylindrical pipes 34" of eductor module 60 is shaped to pass between and about the internal module structure that defines inlet ports 71 and suction chamber 48. Preferably, the pipes form two such clusters disposed in an arcuate manner around the horizontally and laterally disposed suction chamber 48.

The diffuser assembly 72, diffuser throat 73 and motive nozzle 70 is an axially symmetric eductor assembly 69, with the diffuser throat entry 73*a* downstream of the motive nozzle 70 and the converging portion 73*b* of the diffuser and suction chamber 48 disposed about a rearward conical portion 67*a* of second plenum 67 that ends at nozzle 70.

In a preferred embodiment, fluidising fluid in the form of high pressure water is delivered to the first plenum 66 along the annular passage 34 of the mining pipe 35 and adaptor module, then along the annular passage 34' and tubular passages 34" of the eductor module 60. From the first plenum 66, the high pressure water is utilised to drive the jet nozzles 42, 43, 44, while a distinct and separate motive fluid flow, fed from intermediate passage 33 of the mining pipe 35 via annular passage 33' and tubular passages 33" of the eductor module is utilised to drive eductor assembly 69 within eductor module 60.

Various aspects of the eductor arrangement, including motive fluid flowrates through passages 33' and 33", motive nozzle and diffuser specifications are optimised to effectively and economically recover mined material over a significant distance and subterranean height. For a fluidising water delivery pressure in the range 80 to 140 bar (8,000 to 14,000 kPa), an eductor configuration can be optimised for delivering a slurry of mined rutile, ilmenite and/or zircon material all the way back to the swivel at the ground surface, as far as 500-1000 m with a vertical height gain of 70 m, at a flow rate of 200 to 400 $m^3$/hr. Such a configuration is highly effective in achieving economic recovery of heavy mineral sands from underground seams.

A domed head section 79 of nose cone 64 closes the first plenum 66 on the distal side of the nozzle assembly and forms a bulkhead to seal the fluidising jet module 62 and connect the rear end of nose cone 64. Nose cone 64 may include an instrument to detect the mining tool's transverse orientation, and multiple sonar sensors 80 that provide means of obtaining measures of, or "seeing", the shape and volume, and face shape, of the cavity or stope to allow mining operators to see downhole and therefore adjust the mining tool and overall assembly for best affect, in as close to real time is possible. These instruments preferably communicate with surface operators via associated transmitter devices and wireless technology, a modular system bolted to the mining pipe.

Figure 11:
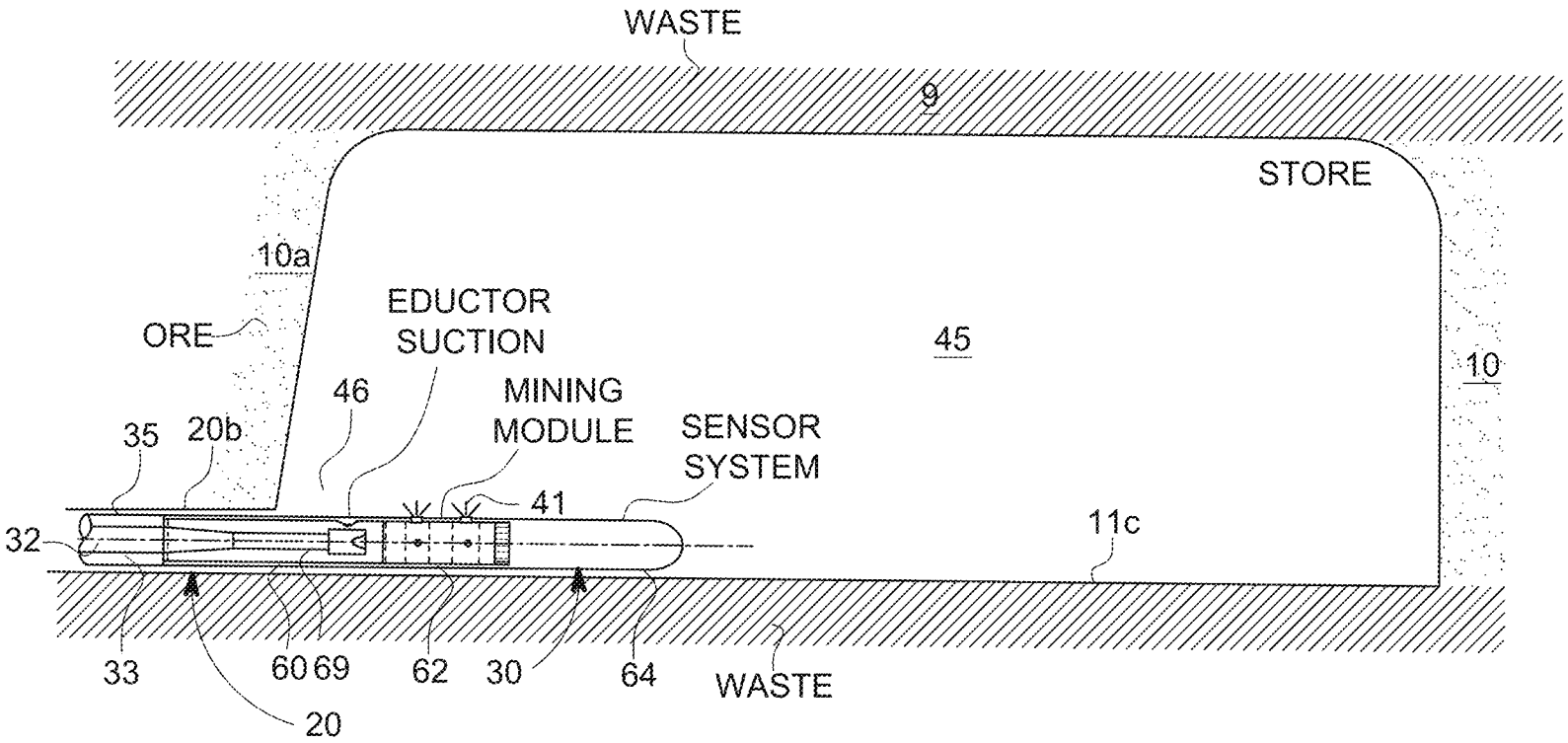
FIG. 11 is a diagram of the mining tool operationally in situ within a stope.

With reference to FIG. 11, as the mining jets 41 emitted by the nozzles disaggregate the material of the seam about the mining tool and the particulates are delivered as a slurry along the central pipe passage 32, mining pipe 35 and the attached mining tool 30 are slowly and steadily drawn rearwardly towards the ground location 18, to expose fresh seam material 10*a* to the jets and to gradually expand the cavity or stope 45 within the seam.

The mining tool is drawn towards the ground surface at a speed that balances the volumetric flow rate of the fluidising fluid and solids concentration in the recovered slurry. Accordingly, the withdrawal speed can range from 0.1 to 10 metres per hour and can be adjusted based on information including, but not limited to, stope profile telemetry from the sensor module and solids concentration in the recovered slurry. The mining tool is preferably withdrawn at a speed ranging from 1 to 3 m/h, or even more preferably at 1.5 m/h.

Once the stope is established, the withdrawal speed is optimised to ensure that the ports defining the fluid entrance to the eductor arrangement are not covered or blocked by the seam material and thus clear of any obstacles preventing the collection and recovery of the entrained slurry. As shown in FIG. 11, the suction chamber 48 in longitudinal alignment with the eductor motive nozzle 70 is positioned at a downstream position of the mined edge of stope 45. As a result, the low pressure capture zone 46 is kept clear of yet-to-be-mobilised seam material, allowing the eductor to be fed with mined slurry without interruption. When in continuous mining operation, the withdrawal speed, nozzle angle and fluid pressure is adjusted to maintain this forward position of the eductor ports relative to the stope edge.

In a typical full scale mining operation, the illustrated mining configuration will be one of plural or multiple such configurations arranged in parallel whereby to extract material from a series of obliquely extending stopes spaced apart in the longitudinal direction of the seam. Each stope may be 6 to 20 m wide, for example 10-15 m wide, and 3-5 m high. It is thought preferable to position the respective boreholes so that the spacing is greater than the cavitation capability of the mining tool so as to leave narrow longitudinally extending pillars (e.g. of 1 m width) between the stopes. This allows better management and control of the materials mined from each stope.

When a stope is excavated, the respective mining tool and its associated mining pipe is withdrawn from the borehole and taken to a newly drilled borehole beyond the most recent of those installed. The open borehole just vacated may be used, with suitable equipment, for backfilling of the mined cavity, for example with non-valuable or waste material, i.e. tails, separated earlier from previously mined valuable ore.

Those skilled in the art will appreciate that the invention described herein is susceptible to variations and modifications other than those specifically described. It is understood that the invention includes all such variations and modifications which fall within the spirit and scope of the present invention.

The invention claimed is:

1. A mining tool for mining an underground seam of material, the mining tool configured to be coupled to a pipe structure that extends along a borehole from a ground surface to the seam, which pipe structure delivering a first and a second high pressure fluid to the mining tool, and having a passage for recovering a slurry containing mined material, wherein the mining tool comprises:

a plenum being connected to and adapted to receive the first high pressure fluid from the pipe structure, one or more fluidising jet nozzles fluidly connected to said plenum and operable with said first high pressure fluid to mobilise material of the seam adjacent to the tool, and an eductor arrangement adapted to recover and entrain said mined material in the second high pressure fluid flow delivered by the pipe structure, to return said material as a slurry through said passage, wherein the first and the second high pressure fluids are fluidly isolated such that the first high pressure fluid received by the plenum is distinct from the second high pressure fluid at the eductor arrangement, wherein said one or more fluidising jet nozzles are distally disposed relative to said pipe structure, and said eductor arrangement is disposed proximally relative to said pipe structure, such that when in use, said one or more fluidising jet nozzles mobilise said material and said eductor arrangement recovers said slurry at said proximal position relative to the pipe structure, while said mining tool is continuously withdrawn towards the ground surface along said borehole.

2. A mining tool according to claim 1, wherein said one or more fluidising jet nozzles are disposed at least between 0 and 3 m from said eductor arrangement.

3. A mining tool according to claim 2, wherein said one or more fluidising jet nozzles are disposed between 1 to 2 m from said eductor arrangement.

4. A mining tool according to claim 1, wherein said mining tool is disposed along a horizontal or substantially horizontal borehole.

5. A mining tool according to claim 1, wherein one or more openings providing fluid connection between said eductor arrangement and said borehole include grille or strainer structures for controlling slurry pressure therethrough and/or controlling fragment sizes of said material in said slurry.

6. A mining tool according to claim 5, wherein said mining tool comprises two said openings disposed on opposing faces of the mining tool.

7. A mining tool according to claim 6, wherein said two opposingly disposed openings are vertically level when in use.

8. A mining tool according to claim 5, wherein said grille or strainer structures are adapted to maintain a slurry suction pressure of between 400 and 800 kPa.

9. A mining tool according to claim 8, wherein said grille or strainer structures are adapted to maintain a slurry suction pressure of 600 kPa.

10. A method for mining an underground seam of material comprising coupling a mining tool to a pipe structure that extends along a borehole from a ground surface to the seam, which pipe structure separately delivering a first high pressure fluid and a second high pressure fluid to said mining tool, and having a passage for recovering a slurry containing mined material, said mining tool having:

a plenum connected to and receiving the first high pressure fluid from the pipe structure;

one or more fluidising jet nozzles fluidly connected to said plenum and directing said first high pressure fluid to mobilise material of the seam adjacent to said mining tool; and an eductor arrangement recovering and entraining said mined material in said second high pressure fluid flow delivered by the pipe structure, returning said material as a slurry along said passage, wherein the first high pressure fluid and the second high pressure fluid are fluidly isolated such that the first high pressure fluid received by the plenum is distinct from the second high pressure fluid at the eductor arrangement, said one or more fluidising jet nozzles being distally disposed relative to said pipe structure, and said eductor arrangement being proximally disposed relative to said pipe structure, wherein said mining tool is continuously withdrawn towards the ground surface along said borehole while fluid is fed to said one or more fluidising jet nozzles and said eductor arrangement such that said material is mobilised from said seam and recovered as said slurry through said proximally located eductor arrangement.

11. A method according to claim 10, wherein said material adjacent to said tool is mobilised by the first high pressure fluid directed by said one or more fluidising jet nozzles disposed at least between 0 and 3 m from said eductor arrangement.

12. A method according to claim 11, wherein said one or more fluidising jet nozzles are disposed between 1 and 2 m from said eductor arrangement.

13. A method according to claim 10, wherein said underground seam of material is mined by said mining tool disposed along a horizontal or substantially horizontal borehole.

14. A method according to claim 10, wherein slurry pressure and/or fragment sizes of said material recovered in said eductor arrangement is controlled by grille or strainer structures comprising one or more openings providing fluid connection between said eductor arrangement and said borehole.

15. A method according to claim 14, wherein said slurry is recovered through two said openings disposed on opposing faces of said mining tool.

16. A method according to claim 15, wherein said mining tool is oriented such that said two opposingly disposed openings are vertically level.

17. A method according to claim 14, wherein said grille or strainer structures maintain said slurry suction pressure to between 400 and 800 kPa.

18. A method according to claim 17, wherein said grille or strainer structures maintain said slurry suction pressure at 600 kPa.

* * * * *